US005275236A

United States Patent [19]

Le Gauyer

[11] Patent Number: 5,275,236

[45] Date of Patent: Jan. 4, 1994

[54] CONNECTING TUBE FOR A HEAT EXCHANGER FLUID HEADER, AND A FLUID HEADER HAVING SUCH A CONNECTING TUBE

[75] Inventor: Philippe Le Gauyer, Paris, France

[73] Assignee: Valeo Thermique Moteur, Le Mesnil-Saint-Denis, France

[21] Appl. No.: 14,616

[22] Filed: Feb. 8, 1993

[30] Foreign Application Priority Data

Feb. 14, 1992 [FR] France ..... 92 01706

[51] Int. Cl.[5] ..... F28F 9/02

[52] U.S. Cl. ..... 165/178; 228/183; 285/189

[58] Field of Search ..... 165/173, 178; 285/176, 285/189, 222; 228/170, 173.4, 183; 29/890.043

[56] References Cited

U.S. PATENT DOCUMENTS

| | | | |
|---|---|---|---|
| 603,244 | 5/1898 | Avery | 285/189 X |
| 1,546,858 | 7/1925 | Nathanson et al. | 165/178 X |
| 2,221,934 | 11/1940 | Ferris | 285/189 X |
| 2,636,752 | 4/1953 | Schane et al. | 285/189 |
| 3,971,500 | 7/1976 | Kushner | 228/154 |
| 4,175,308 | 11/1979 | Togashi | 165/178 X |
| 4,334,703 | 6/1982 | Arthur et al. | 285/222 |
| 4,620,590 | 11/1986 | Koisuka et al. . | |
| 5,094,293 | 3/1992 | Shinmura | 165/178 |

FOREIGN PATENT DOCUMENTS

| | | | |
|---|---|---|---|
| 2189142 | 1/1974 | France | B21D 53/00 |
| 2249299 | 5/1975 | France | F28F 9/00 |
| 2498495 | 7/1982 | France | B21D 29/06 |
| 58-221393 | 12/1983 | Japan | F28F 9/18 |
| 2167850 | 12/1984 | United Kingdom | F28F 1/30 |

*Primary Examiner*—Allen J. Flanigan
*Attorney, Agent, or Firm*—Morgan & Finnegan

[57] ABSTRACT

A connecting tube for a fluid header of a heat exchanger, especially a tubular header for a condenser of an air conditioning installation for a motor vehicle, comprises a cylindrical tubular body delimited by a metallic wall and extended by a flattened tubular end portion formed by deformation of the wall and arranged to be fitted into an oblong aperture formed in a metallic wall of the fluid header. The connecting tube has at least one shear cut, formed in the thickness of the wall and extending over part of the periphery of the connecting tube in a region lying between the body and the flattened end portion. The shear cut defines a frontal lip which bears against the wall of the fluid header after the flattened end portion has been fitted in the latter.

10 Claims, 1 Drawing Sheet

CONNECTING TUBE FOR A HEAT EXCHANGER FLUID HEADER, AND A FLUID HEADER HAVING SUCH A CONNECTING TUBE

FIELD OF THE INVENTION

The present invention is concerned with heat exchangers, and in particular those which are intended to be used as condensers in air conditioning installations for motor vehicles. It is however to be understood that the invention is also applicable to other types of heat exchangers.

Heat exchangers of this type comprise at least one fluid header, which is connected to a bundle of tubes and which is provided with at least one connecting tube or branch, to serve as the inlet or outlet for a fluid which may, for example, be a coolant fluid in the case of a condenser. In such heat exchangers there may be either a single fluid header which is joined to a tube bundle of hairpin or U shape, or else two fluid headers which are joined respectively to two ends of a straight tube bundle.

The invention is concerned more particularly with a connecting tube for a fluid header of a heat exchanger, in which the connecting tube comprises a cylindrical tubular body delimited by a metallic tube wall and extended by a flattened tubular end portion which is obtained by deformation of the tube wall, this end portion being adapted to be fitted (e.g. by force-fitting) into an oblong aperture formed through a metallic header wall of the fluid header. The invention also concerns a fluid header that includes such a connecting tube.

BACKGROUND OF THE INVENTION

Connecting tubes of the type defined above are generally attached to fluid headers of small transverse dimensions, and in particular to tubular fluid headers such as those used in condensers. Such connecting tubes generally have a circular cylindrical body, and they are usually attached to circular cylindrical fluid headers, the diameter of which is similar to that of the body of the connecting tube.

By flattening the end portion of the connecting tube so as to give it a generally oblong shape, fitting of the tube into an oblong aperture formed in the wall of the fluid header is facilitated, while some latitude is afforded in the choice of location and orientation of the connecting tube in relation to the fluid header.

In known connecting tubes of this type, the deformation of the end portion, in order to flatten it, is carried out in a progressive manner starting with the cylindrical body, which also creates a transition zone (or intermediate deformation zone) in which the wall of the connecting tube defines a rounded shoulder. This is the case, in particular, in the heat exchanger disclosed in the specification of French published patent application FR 2 249 299A, although the fluid header and the connecting tube of that heat exchanger may be made of a plastics material, which is not the case in the present invention.

As a result, in the above mentioned transition zone, the connecting tube cannot preserve such a high resistance to fluid pressure as in the actual body of the tube itself. In addition, the transition zone increases the height or length of the connecting tube, due to the fact that its cylindrical body is necessarily attached at a certain distance from the wall of the fluid header, and this depends on the radius of curvature of the rounded shoulder.

DISCUSSION OF THE INVENTION

A main object of the invention is to overcome the above mentioned drawbacks.

According to the invention in a first aspect, a connecting tube, for a fluid header of a heat exchanger and comprising a cylindrical, tubular body which is delimited by a metallic wall and extended by a flattened tubular end portion, the latter being formed by deformation of the wall and adapted to be fitted into an oblong aperture formed in a metallic wall of the fluid header, is characterised in that the connecting tube has at least one shear cut, which is formed in the thickness of the wall and which extends over part of the periphery of the connecting tube in a region lying between the body and the flattened end portion, so as to define a frontal lip situated on the side of the body and adapted to bear against the wall of the fluid header after the flattened end portion of the connecting tube has been fitted into the oblong aperture in the fluid header.

Thus, instead of having a transition zone where the wall of the connecting tube is progressively deformed as was the case in the prior art, the wall of the connecting tube defines a sharp change of profile, or depression, in a region lying between the body and the flattened end portion of the tube. This sharp change of profile results from the shear cut, which also defines a lip which is adapted to be applied against the wall of the fluid header when the connecting tube is fitted into the latter.

As a result, the cylindrical shape of the body of the connecting tube is preserved, as far as the zone in which the shear cut is situated. This enables the connecting tube to be cylindrical over its whole length extending from the wall of the fluid header, and this in turn improves its ability to withstand internal fluid pressure. In addition, because there no longer exists a transition zone between the cylindrical body and the flattened end portion of the connecting tube, the height of the latter is reduced.

According to a preferred feature of the invention, it includes at least one shear cut which is formed at least partly over a depth greater than the thickness of the wall, whereby to define a slot at a sharp change of profile of the wall.

In a variant, it includes at least one shear cut formed to a depth which is less than the thickness of the wall. This produces a change in dimension of the wall without formation of a slot as in the preceding paragraph.

The invention is applicable in particular to a connecting tube in which the flattened end portion has two flat and opposed wall portions. According to another feature of the invention, the connecting tube then has two shear cuts, each of which is formed close to a respective one of these two wall portions.

Preferably, the frontal lip defined by the shear cut has a profile such as to be fit the shape of the wall of the fluid header after the connecting tube has been fitted into the latter. This arrangement gives a mating cooperation between the connecting tube and the fluid header, which makes it easier to secure them together.

In a preferred form of the invention, the body of the connecting tube is in the form of a circular cylinder.

According to the invention in a second aspect, a heat exchanger fluid header comprising a metallic wall in which an oblong aperture is formed, is characterised in that it is provided with a connecting tube according to the invention in its first aspect, with the flattened end portion of the said connecting tube being fitted into the oblong aperture in such a way that the frontal lip of the shear cut in the connecting tube abuts against the wall of the fluid header.

Preferably, its metallic wall has parallel generatrices, and in that the oblong aperture has a major dimension which extends in a direction substantially parallel to the said generatrices.

According to a further preferred feature of the invention, the metallic wall of the fluid header is in the form of a circular cylinder.

In a preferred embodiment of the invention, the connecting tube is secured to the fluid header by welding or brazing.

The description of a preferred embodiment of the invention which follows is given by way of example only, and with reference to the accompanying drawings.

DESCRIPTION OF A PREFERRED EMBODIMENT OF THE INVENTION

Figure 1:
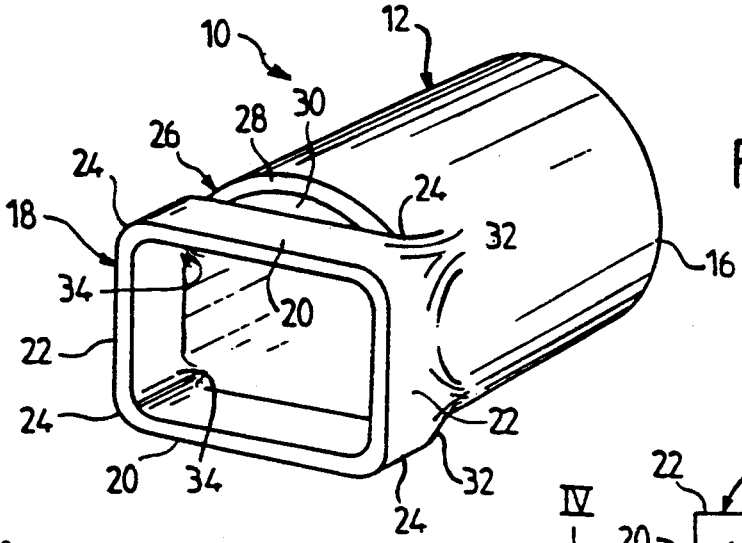
FIG. 1 is a perspective view of a connecting tube in accordance with the invention.

Reference is first made to FIGS. 1 to 4, which show a connecting tube 10 that comprises a cylindrical tubular body 12. The body 12 in this example is configured as a circular cylinder defining an axis X—X (see FIGS. 2 and 4). The body 12 is delimited by a metal wall 14, which may for example be of copper or aluminium, and the thickness of which is indicated at e in FIG. 4. The body 12 has a first end 16 which in this example is straight, but which could be of bent form if desired. On the side opposite to the end 16, the body 12 is extended by a flattened tubular end portion 18 which is obtained by deformation of the wall 14.

In this example, the end portion 18 has a right oblong cross section of substantially rectangular shape, delimited by two wall portions 20, which are parallel to each other and which extend over a length $L_1$, and by two further wall portions 22. The wall portions 22 are also parallel with each other, and extend over a length $L_2$ which is less than $L_1$ (see FIGS. 1 and 2). The wall portions 20 are joined to the wall portions 22, at right angles, through rounded corner portions 24. In this example, the outer length $L_1$ of the flattened end portion 18 is substantially equal to the outer diameter D of the body 12, while the outer length $L_2$ is substantially less than $D-2e$. The flattened end portion 18 thus forms a generally rectangular enclosure, the generatrices of which are parallel to the axis X—X.

The flattened end portion 18 is obtained at least partly by means of a shearing action, which is applied to the wall 14 of the connecting tube in a direction substantially perpendicular to the axis X—X, and in a predetermined region lying between the body 12 and the end portion 18. In this particular example, the connecting tube has two cuts formed by shearing and indicated at 26, these cuts being formed in the thickness e of the wall 14 and in opposed regions of the latter. The shearing action is carried out in two directions close to the perpendicular to the axis X—X. The cuts 26 are made to a maximum depth which is substantially equal to $2e$, and which is therefore greater than the thickness of the wall 14.

Figure 2:
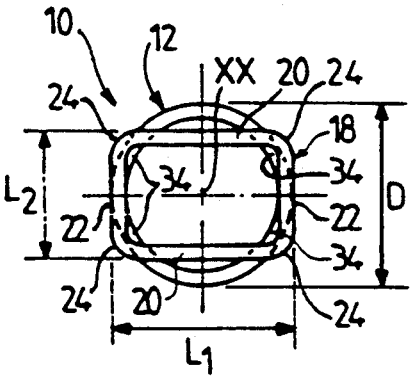
FIG. 2 is an end view of the connecting tube seen in FIG. 1, looking towards its flattened end.
Figure 3:
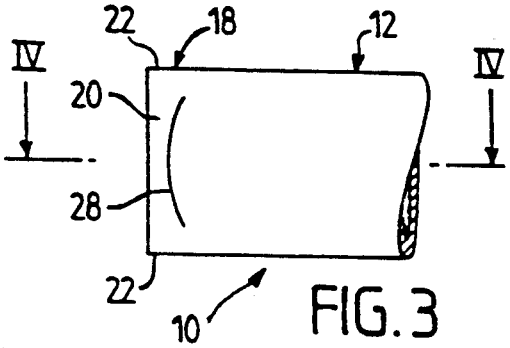
FIG. 3 is a top plan view showing part of the connecting tube of FIGS. 1 and 2.
Figure 4:
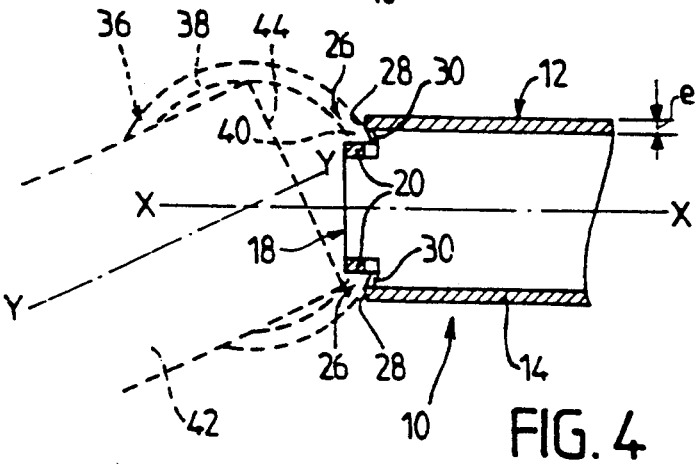
FIG. 4 is a view in cross section taken on the line IV—IV in FIG. 3, showing the attachment of the connecting tube to a fluid header of a heat exchanger which is shown in broken lines.

Each of the shearing cuts 26 forms a front lip 28 which is situated at the side of the body 12, and which is generally in the form of an arc of a circle of non-flat configuration (as can be seen in FIGS. 1 to 4). Since each of these cuts has a maximum depth which is greater than the thickness of the wall 14, a slot 30, which can be seen in FIGS. 1, 2 and 4, is formed between each lip 28 and the adjacent wall portion 20. The wall 14 of the body 12 thus defines two recesses which are situated in diametrically opposed regions and which terminate at the two wall portions 20.

The four rounded corner portions 24 of the flattened end portion 18 project beyond the outer wall of the body 12, as is best seen in FIG. 2. The shearing operation thus produces four chamfers 32, which join the respective corner portions 24 to the outer surface of the body 12, together with four further chamfers 34 which join the interior of the respective corner portions 24 to the interior of the body 12.

As is best seen in FIG. 4, to which reference is now made, the flattened end portion 18 of the connecting tube 10 is designed to be fitted into a fluid header 36 of a heat exchanger shown in broken lines. In this example, the fluid header 36 is delimited by a metallic wall 38 of circular cylindrical shape, the generatrices of which extend at right angles to the plane of the paper. An oblong aperture 40 is formed in the wall 38. The aperture 40 has an internal contour of homologous shape to the external contour of the flattened end portion 18, so as to match the two components together. The aperture 40 thus has a generally rectangular oblong shape, the smaller dimension of which extends in the plane of the drawing, with its larger dimension extending at right angles to the plane of the drawing, that is to say parallel to the generatrices of the wall 38.

In the present example, the fluid manifold 36 is part of a heat exchanger and is joined to the tubes 42 of a tube bundle. Each tube 42 in the bundle extends in a direction Y—Y, which is not parallel to X—X. Each tube has a first end 44 which is introduced into a matching aperture formed in the wall 38. Each tube also has an opposite end (not shown in the drawings), which is arranged to be received in a similar fluid manifold.

As can be seen in FIG. 4, each of the two frontal lips 28 of the connecting tube 10 bears against the metal wall 38 of the fluid manifold 36, so as to form a sealing abutment. As has already been indicated above, each of the frontal lips 28 has the shape of a non-flat arc of a circle. This is best seen in FIG. 3. The non-flat shape of the arc is so chosen that each lip 28 has a profile such as to abut against the wall 38 after the flattened end portion 18 has been force-fitted into the aperture 40. After being so fitted, the connecting tube 10 is secured positively to the fluid manifold 36 by brazing or welding, so as to produce (by melting) a mass of metal which fills the free spaces between the connecting tube 10 and the aperture 40. As will be understood from FIG. 4, the connecting tube 10 may be disposed in any desired location, and in any desired orientation, with respect to the wall 38 of the header 36.

Figure 5:
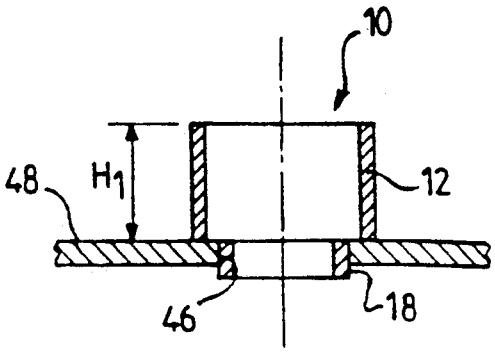
FIG. 5 is a view in longitudinal cross section of a connecting tube in accordance with the invention, attached to a flat wall of a fluid header.

Referring now to FIG. 5, the flattened end portion 18 of the connecting tube 10 is here engaged in an aperture 46 which is formed through a flat wall 48 of a fluid manifold. Given that the flattened end portion 18 is the result of a cutting action performed by shearing, the size of the connecting tube corresponds to the height $H_1$ of its body 12.

It will be understood that in this way an approximately cylindrical shape can be preserved in the connecting tube over its whole length, which is beneficial to its ability to contain pressure (as has already been indicated).

Figure 6:
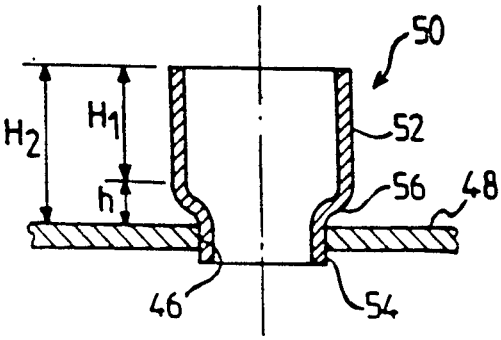
FIG. 6 is a view similar to that seen in FIG. 5, showing, for purposes of comparison, a connecting tube of the prior art attached to a similar flat wall of a header.

Reference will now be made to FIG. 6, which shows, for purposes of comparison only, a connecting tube 50 of the prior art. This tube 50 comprises a cylindrical body 52 which is joined to a flattened end portion 54 thorugh a transition zone 56, in which the wall of the tube defines a rounded shoulder. Due to the existence of this transition zone, the connecting tube has a total length $H_2$ which, for a body 52 of the same height $H_1$ as the body 12 in FIG. 5, is greater than $H_1$. In this example the height $H_2$ is equal to $H_1+h$, where the value h represents the height of the transition zone 56. This height h may itself vary having regard to the variation in the elastic limit of the material of which it is made.

The invention is applicable to the fitting of connecting tubes on to fluid headers of heat exchangers, and in particular headers which form part of condensers for air conditioning installations in motor vehicles.

What is claimed is:

1. A connecting tube for a heat exchanger fluid header having a metallic header wall defining an oblong through aperture therein, wherein the connecting tube comprises a metallic tube wall defining a tubular cylindrical body and a flattened tubular end portion extending the said body and obtained by deformation of the said tube wall, the said end portion being adapted to be fitted in an oblong aperture formed in the header wall of a said fluid header, the connecting tube defining at least one shear cut formed in the thickness of its wall and extending over part of the periphery of the connecting tube in a region lying between the said body and the said flattened end portion, so as to define a frontal lip situated on the side of the body and so configured as to bear against a said header wall after the end portion has been fitted into the oblong aperture of the latter.

2. A connecting tube according to claim 1, having at least one said shear cut, formed at least partly over a depth greater than the thickness of its wall whereby to define a sharp change in the profile of the said wall and a slot at the said change of profile.

3. A connecting tube according to claim 1, having at least one said shear cut, formed over a depth less than the thickness of its wall.

4. A connecting tube according to claim 1, wherein the flattened end portion comprises two flat, opposed wall portions, the connecting tube having two shear cuts formed respectively close to the two said wall portions.

5. A connecting tube according to claim 1, wherein the said frontal lip defines a profile such as to fit the shape of the associated wall of a said fluid header after the connecting tube has been fitted to the latter.

6. A connecting tube according to claim 1, wherein the said body is in the form of a circular cylinder.

7. A heat exchanger fluid header comprising a metallic header wall defining an oblong aperture therein, with a connecting tube according to claim 1 having its flattened end portion fitted into the said oblong aperture and with its frontal lip in abutment against the said wall of the fluid header.

8. A fluid header according to claim 7, wherein its said metallic wall defines parallel generatrices, with the oblong aperture therein having a major dimension extending in a direction substantially parallel to the said generatrices.

9. A fluid header according to claim 8, wherein the metallic header wall is in the form of a circular cylinder.

10. A fluid header according to claim 7, wherein the connecting tube is secured to the fluid header by welding or brazing.

* * * * *